United States Patent [19]

Ngian et al.

[11] Patent Number: 4,651,469

[45] Date of Patent: Mar. 24, 1987

[54] SLIDING DOOR MECHANISM

[75] Inventors: Ho Y. Ngian; Yeo C. Lay, both of Singapore, Singapore

[73] Assignee: Genaplast Pte. Ltd., Singapore, Singapore

[21] Appl. No.: 755,272

[22] Filed: Jul. 15, 1985

[30] Foreign Application Priority Data

Jul. 18, 1984 [GB] United Kingdom ..... 8418237

[51] Int. Cl.[4] ..... E05D 15/10

[52] U.S. Cl. ..... 49/223; 16/87 R; 49/217; 49/225; 49/409; 49/411

[58] Field of Search ..... 49/409, 410, 411, 412, 49/209, 210, 217, 225, 223; 16/93 R, 87 R

[56] References Cited

U.S. PATENT DOCUMENTS

| | | | |
|---|---|---|---|
| 1,106,233 | 8/1914 | Mueller | 49/223 X |
| 2,990,566 | 7/1961 | Lee | 16/87 R |
| 3,132,884 | 5/1964 | Ahlgren | 49/209 X |
| 3,925,933 | 12/1975 | Reuter | 49/409 |
| 4,404,770 | 9/1983 | Markus | 49/409 X |
| 4,452,014 | 6/1984 | Markus | 49/210 X |
| 4,457,108 | 7/1984 | Kuschel et al. | 49/225 X |
| 4,476,652 | 10/1984 | Beauchot | 49/410 X |

FOREIGN PATENT DOCUMENTS

| | | | |
|---|---|---|---|
| 2151063 | 4/1973 | Fed. Rep. of Germany | 49/217 |
| 1130569 | 10/1968 | United Kingdom | 49/210 |

*Primary Examiner*—Philip C. Kannan

*Attorney, Agent, or Firm*—Paul L. Sjoquist

[57] ABSTRACT

A sliding door mechanism for closing an aperture in a wall comprises an elongate support, a hanger pivotally connected to the support and arranged to be fixed to the door, and an arm on the support extending in the length direction thereof and carrying spaced apart first rollers. A track which, in use, is fixed to the wall, receives the first rollers. A guide rail mounted on the track. Second rollers are mounted on the support for engaging the guide rail. The arrangement is such that, in use, as the door reaches a closed position in which it closes the aperture from an open position in which the aperture is not obstructed by the door, the guide rail and second rollers causes the support to pivot about the contact points of the first rollers with the track and the hanger pivots relative to the support.

10 Claims, 12 Drawing Figures

Fig. 9.
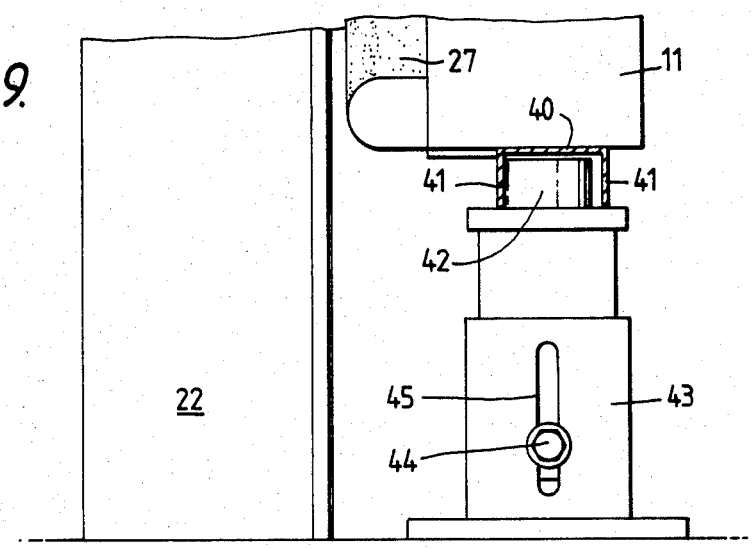
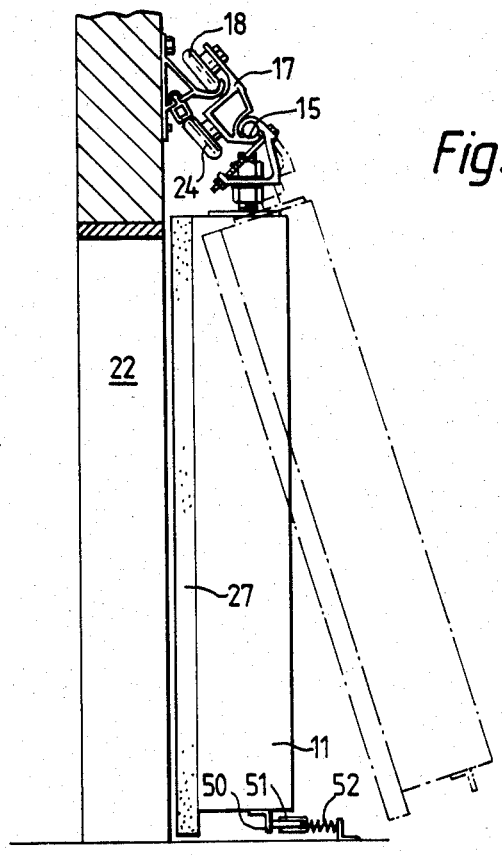
Fig. 10.

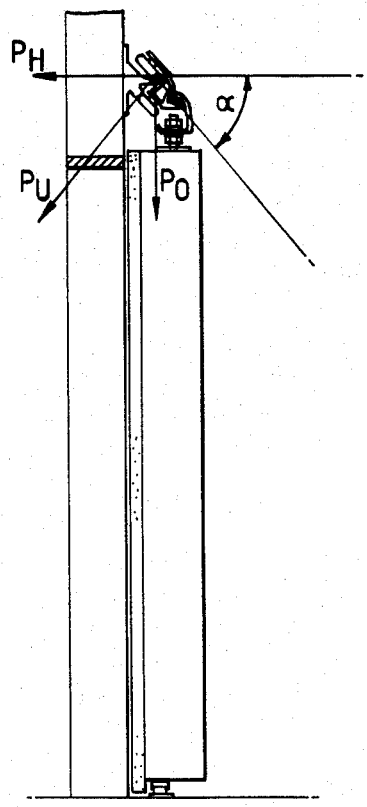
Fig.11.
Fig.12.
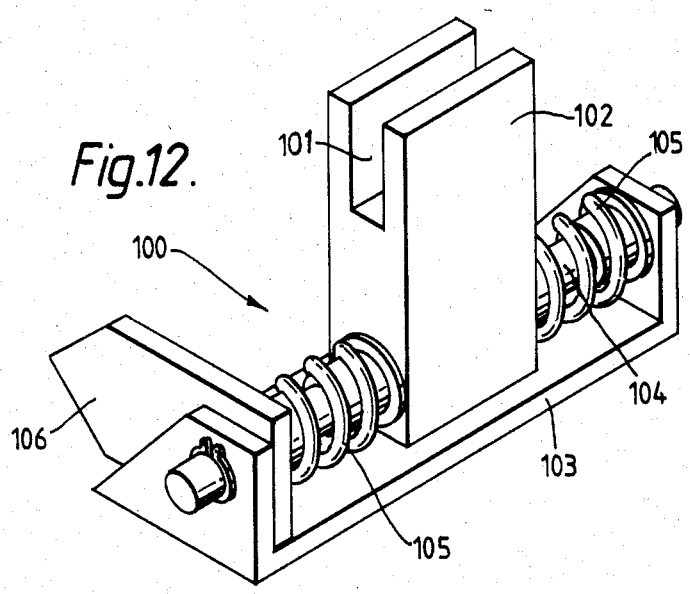

SLIDING DOOR MECHANISM

This invention relates to sliding door mechanisms.

According to the present invention, there is provided a sliding door mechanism for closing an aperture in a wall comprising: an elongate support means; hanger means pivotally connected to the support means and arranged to be fixed to the door; an arm on the support means extending in the length direction thereof and carrying a plurality of spaced apart first rollers; a track which, in use, is fixed to the wall and receives the first rollers; a guide rail mounted on the track; and at least one second roller mounted on the support means for engaging the guide rail, the arrangement being such that, in use, as the door reaches a closed position in which it closes the aperture from an open position in which the aperture is not obstructed by the door, the guide rail and the said at least one second roller causes the support means to pivot about the contact points of the first rollers with the track and the hanger means pivot relative to the support means.

The arm of the support means may be at an angle of greater than 45° (preferably 50°) to the horizontal when the door is in the open position and may be at angle of 60° (and preferably 70°) or greater to the horizontal when the door is in the closed position.

In one embodiment the axes of rotation of the first and second rollers are substantially parallel.

The surface of each first roller engaging the track may be convex or concave.

In another embodiment of the present invention the guide rail may be cylindrical, the or each second roller having a concave surface in contact therewith.

The sliding door mechanism may include a guiding device, in use, arranged adjacent a lower edge of the door, the guiding device having a spring-loaded member urging the door towards the aperture in the closed position.

The sliding door mechanism may include braking means on the track for engaging one of the first rollers as it reaches the closed position to reduce the speed of movement of the door as it approaches the closed position and/or the open position.

The invention is illustrated, merely by way of example, in the accompanying drawings, in which:

FIG. 9 shows a guiding device of a sliding door mechanism according to the present invention;

FIG. 10 shows another form of guiding device of a sliding door mechanism according to the present invention;

FIG. 11 shows schematically the direction of forces acting upon a sliding door mechanism according to the present invention in use; and FIG. 12 is an isometric view of a connector for use with a sliding door mechanism according to the present invention.

Throughout the drawings and description like parts have been designated by the same reference numerals.

Figure 1:
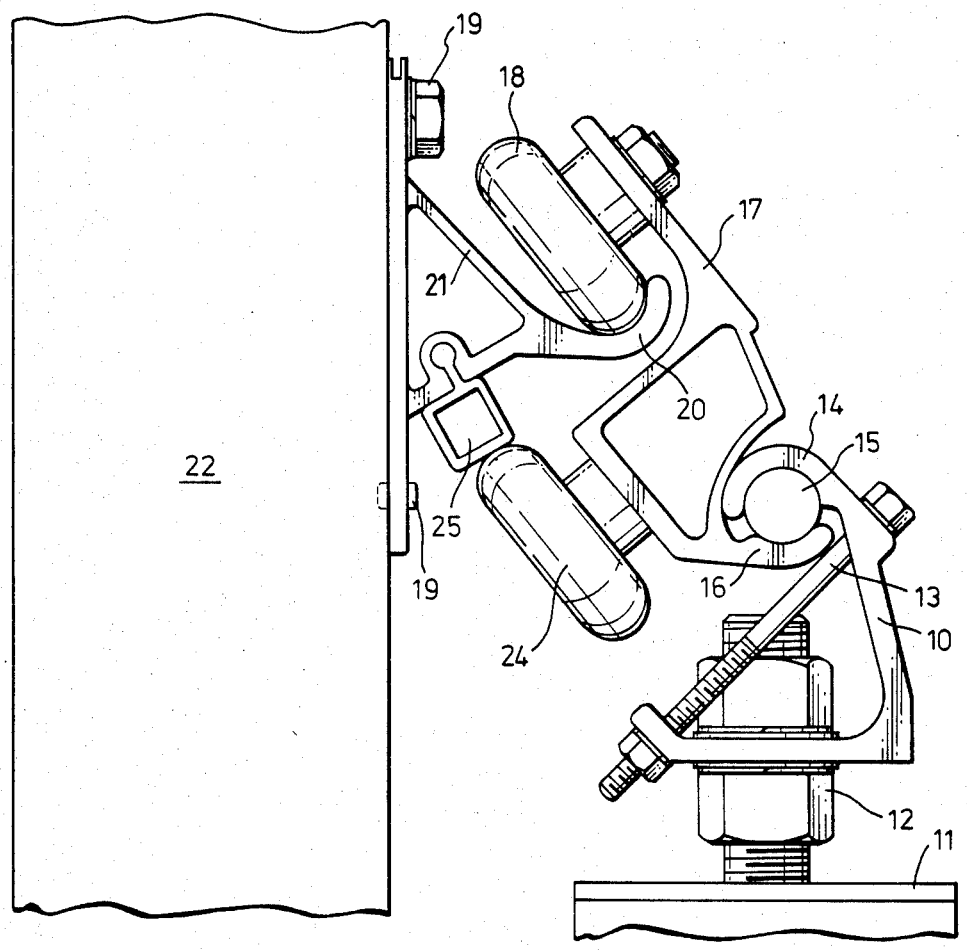
FIG. 1 is an end elevation of one embodiment of a sliding door mechanism according to the present invention.
Figure 2:
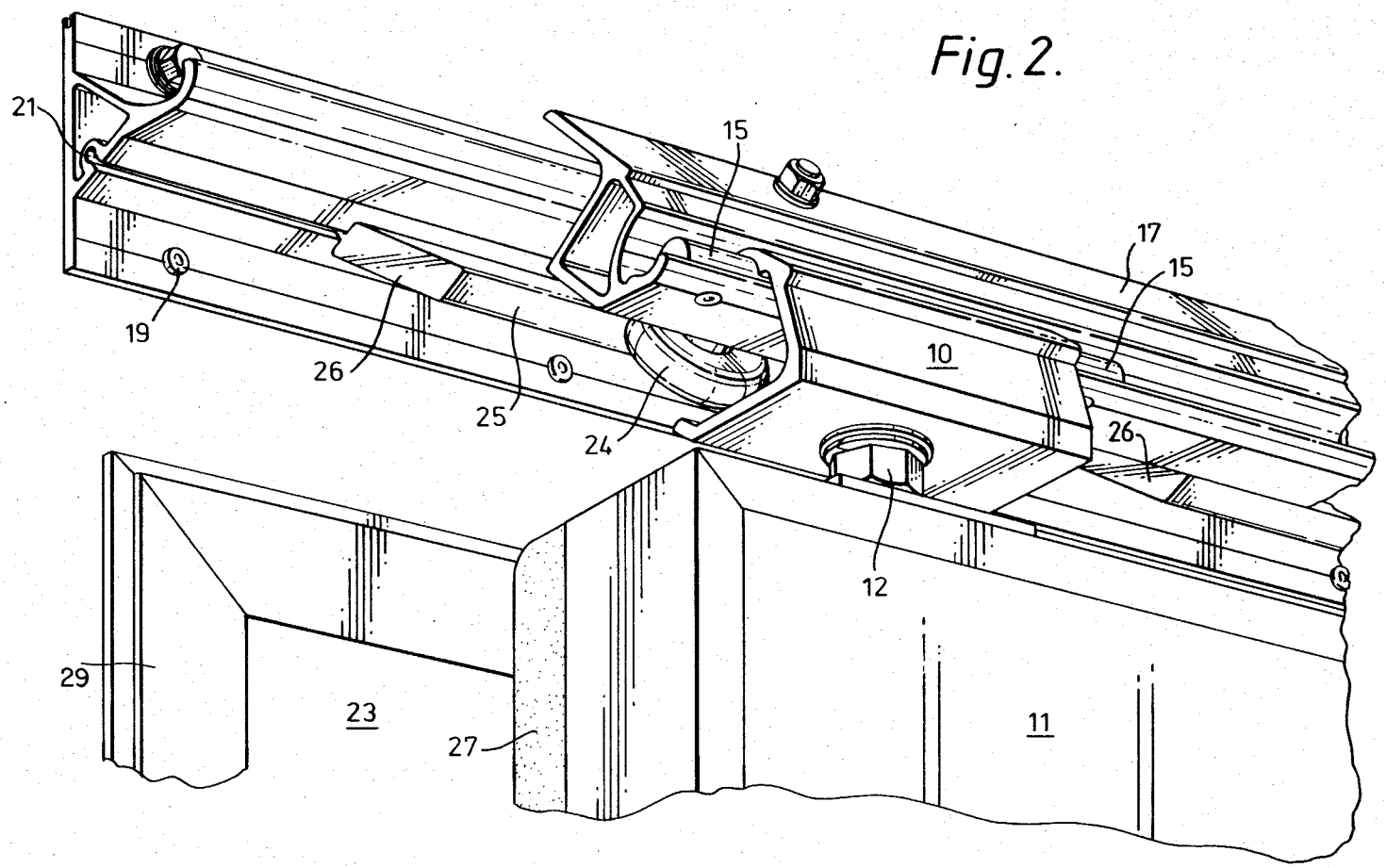
FIG. 2 is a perspective view of a sliding door mechanism of FIG. 1.

Referring first to FIGS. 1 and 2 there is shown one embodiment of a sliding door mechanism according to the present invention. The sliding door mechanism comprises a pair (only one shown) of hangers 10 located at opposite ends of a door 11 in the width direction. Each hanger 10 is adjustably fixed to the door by fasteners 12. If the door is particularly heavy it may be desirable to strengthen the hangers by means of tie bolts 13. Each hanger 10 has an arcuate seat 14 in contact with one side of a cylindrical bearing block 15 which is secured to the hanger 10 by screws (not shown). The other side of each bearing block is located in a seat 16 of an elongate support means or sliding track 17 which is substantially coextensive with the width of the door.

The track 17 carries a pair of spaced apart first rollers 18 located at positions adjacent opposite ends of the door in the width direction. These rollers 18 are received and run in a groove 20 of a stationary track 21 which is fixed by bolts 19 or other fastening means (e.g. rivets) to, for example, a wall 22 in which there is an aperture 23 (FIG. 2) to be sealed by the door in a closed position. The length of the track 21 is such as at least to allow the door to move parallel to the wall between an open position in which the door does not obstruct the aperture in the wall and the closed position.

The sliding track carries a pair of spaced apart second rollers 24 also located at positions adjacent opposite ends of the door. The rollers 24 bear against the guide rails 25 which is fixedly secured to the track 21. The rail 25 has ramp surfaces 26 (FIG. 2) at locations corresponding to the positions of the rollers 24 just before the door reaches the closed position.

Figure 3:
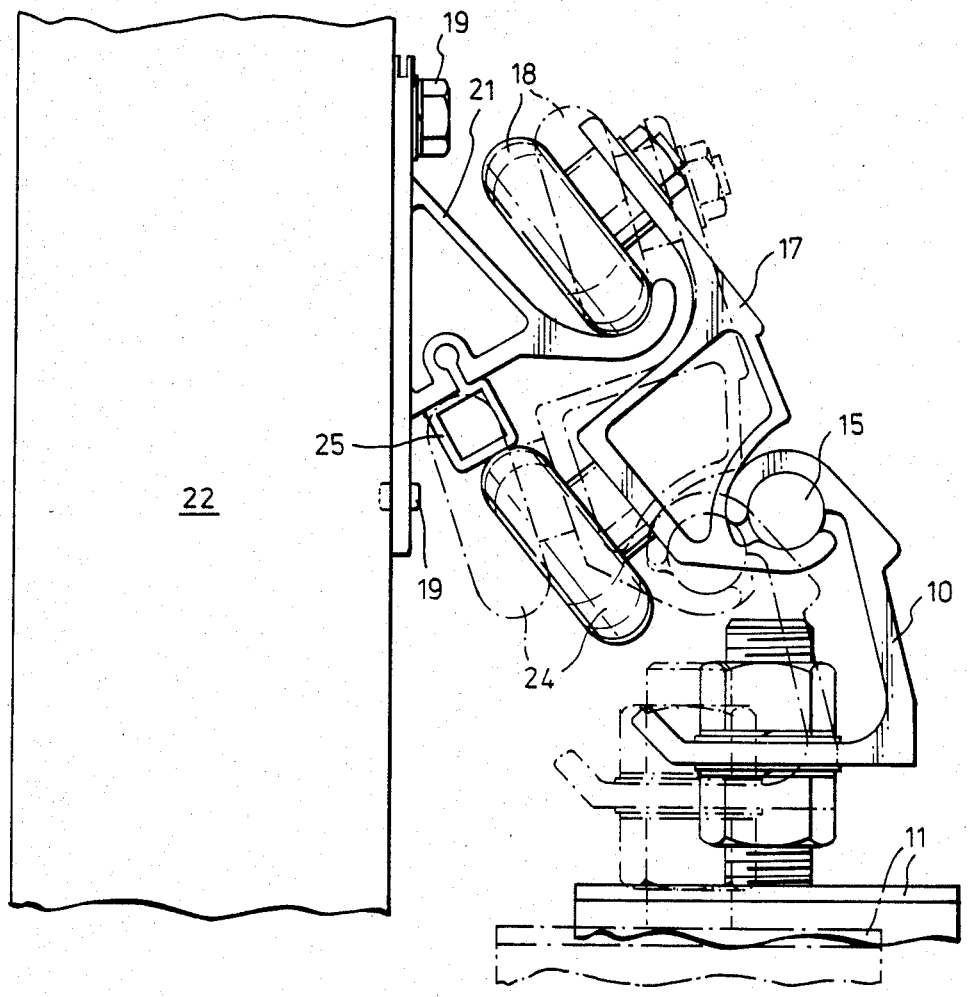
FIG. 3 is a view similar to FIG. 1 illustrating the operation of the sliding door mechanism.

FIG. 3, which is similar to FIG. 1 but with the tie bolts 13 omitted, shows, in solid lines, the sliding door mechanism when the door is in the open position and, in broken lines, the sliding door mechanism when the door is in the closed position. In the open position the door is spaced from the wall 22 by virtue of engagement of the rollers 24 with the rail 25, the weight of the door being carried by the track 21 and the rail 25 which is fixed to the wall, the rail 25 taking a greater proportion of the load. As the door moves towards the closed position the rollers 18 run in the groove 20 of the track 21 and the rollers 24 run along the rail 25. Just before the door reaches the closed position the rollers 24 descend at the ramp surfaces 26 and run directly on the track 21. As the rollers descend the ramp surfaces, the door moves downwardly and towards the aperture in the wall, the rollers 18 pivoting about their points of contact with the groove 20. To ensure that the door remains vertical and no undue strain is placed on the sliding door mechanism by virtue of the movement of the door towards the aperture, the hangers 10 pivot relative to the track 17 about the bearing blocks 15.

The door carries a compressible seal 27 around its edge facing an architrave 29 surrounding the aperture 23. The movement of the door towards the aperture as it reaches the closed position compresses the seal 27 against the architrave so sealing the periphery of the aperture.

The advantage of the sliding door mechanism of FIGS. 1 and 2 is that as the door reaches the closed position, the door moves suddenly towards the wall as well as downwards exerting a considerable force on the seal 27 thereby producing an effective seal around the aperture 23. The sliding door mechanism also ensures that during movement of the door from the closed position, the door is quickly moved upwards away from the aperture so prolonging the life of the seal through lower wear and tear. The leverage in the sliding door mechanism enables the door to be opened with little applied effort.

The tracks 17, 21 and the hangers 10 may be extruded of aluminium so reducing the weight of the sliding door mechanism and also reducing cost of manufacture.

In the embodiment of the present invention shown in FIGS. 1 to 3, the axes of the rollers 18, 24 are substantially parallel, the axes being at an angle of at least 45° and preferably greater than 50° to the vertical in the open position and at least 60° and preferably 70° or greater to the vertical in the closed position. This means that the force compressing the seal 27 in the closed position is around 60% of the weight of the door so that the door moves to the closed position with less violence and less wear on the seal 27. The corollary is that less force is required to move the door from the closed position to the open position.

Figure 4:
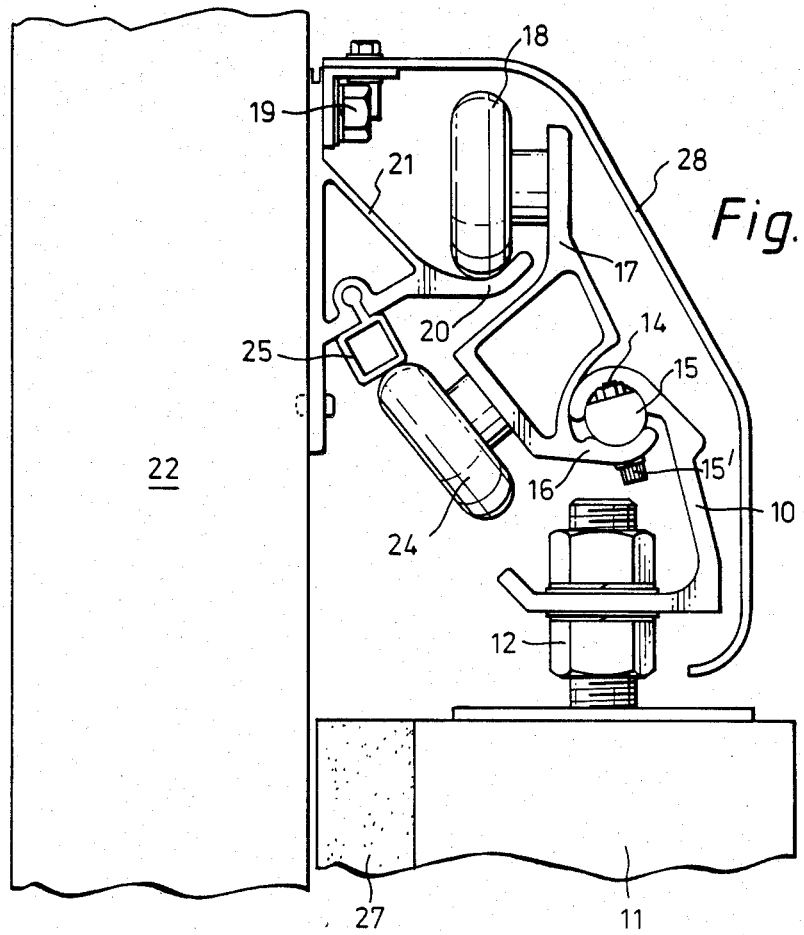
FIG. 4 shows a modification of the sliding door mechanism of FIG. 1.

It is not essential that the axes of the rollers 18,24 are parallel. FIG. 4 shows a modification of the sliding door mechanism of FIG. 1 in which the axes of the rollers 18 are horizontal and the axes of the rollers 24 are at an angle of at least 45° and preferably greater than 50° to the vertical in the open position and at least 60° and preferably 70° or greater to the vertical in the closed position. This embodiment shows a cover 28 protecting the sliding door mechanism from dirt, moisture, etc., for example, from entering the track 17,21. The cover 28 is shown bolted to the track 21, but it may, if desired, be integral therewith. FIG. 4 also shows end stops inserted into holes (not shown) at each end of the bearing block permitting its rotation. The end stops are secured to the seat 16 by means 15' such as screws or bolts.

Figure 5:
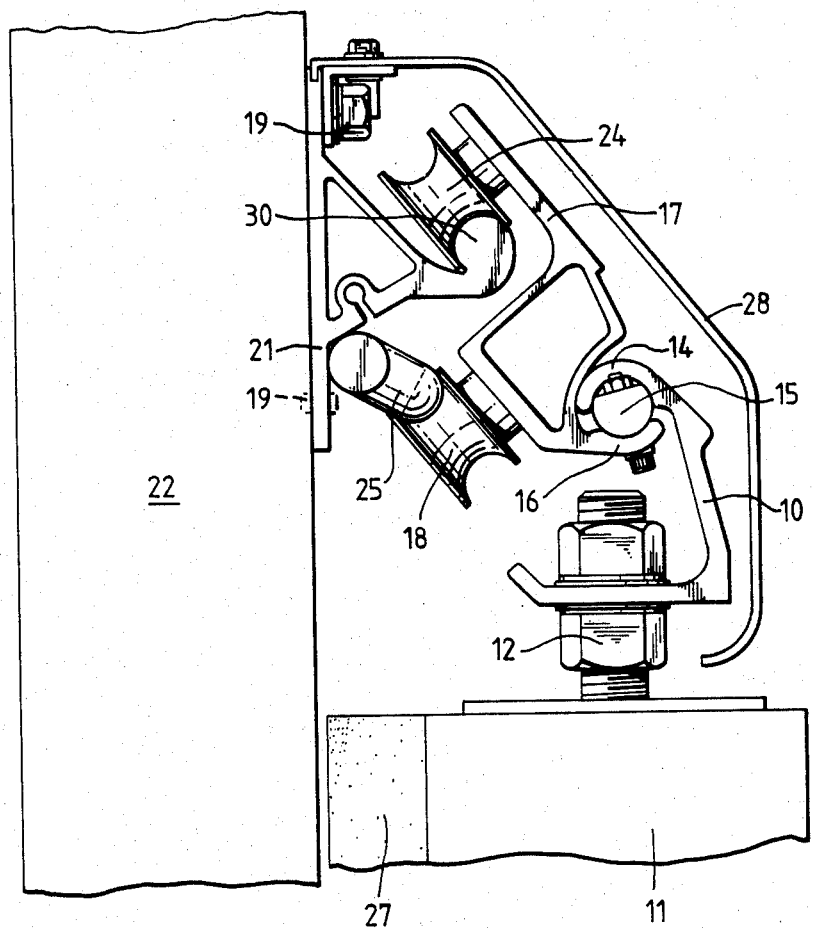
FIG. 5 is an end elevation of another embodiment of a sliding door mechanism according to the present invention.

FIG. 5 shows another embodiment of a sliding door mechanism according to the present invention. Instead of having a convex surface in contact with the groove 20 as in the sliding door mechanism of FIG. 1, in FIG. 5 the rollers 18 have a concave surface cooperating with a part cylindrical portion 30 of the track 21. The rollers 24 cooperate with a cylindrical guide rail 25. The sliding door mechanism of FIG. 5 operates in the same manner as that of FIG. 1 and so will not be described further.

Figure 6:
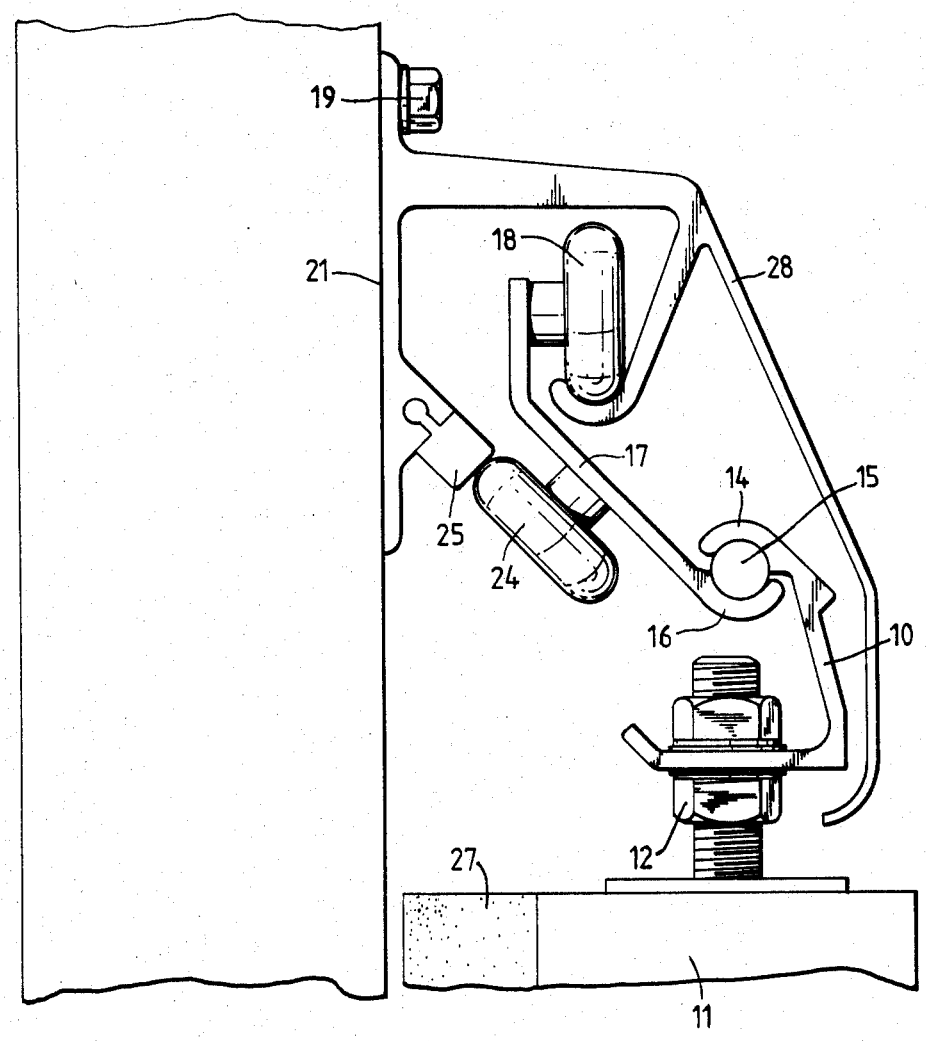
FIG. 6 is an end elevation of a further embodiment of a sliding door mechanism according to the present invention.

The sliding door mechanism according to the present invention and illustrated in FIG. 6 is similar to that of FIG. 4 except that the tracks 17,21 are of a different shape. In this embodiment the cover 28 is seen as integral with the track 21.

Figure 7:
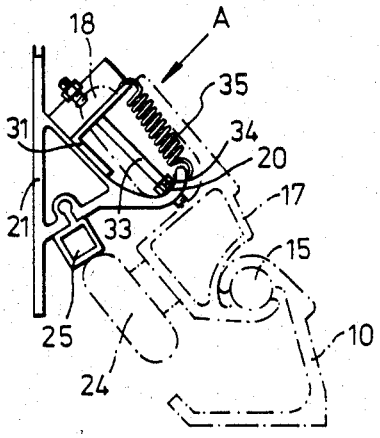
FIG. 7 illustrates a braking device of the sliding door mechanism of FIG. 1.
Figure 8:
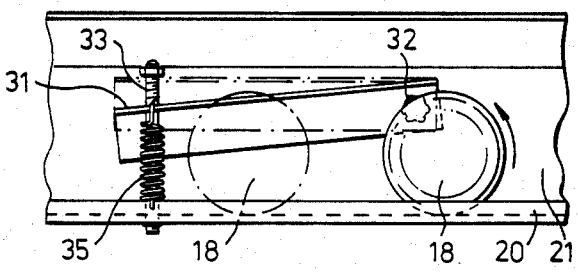
FIG. 8 is a view of the braking mechanism of FIG. 7 in the direction of arrow A.

It will be appreciated that it is necessary to stop movement of the door at both ends of the track 21. Conventional stops may be provided but preferably there are braking devices as shown in FIGS. 7 and 8. Each braking device comprises a shoe 31 pivotally mounted on the track 21 at a point 32. The distal end of the shoe is guided for movement along a rod 33 fixed by a nut 34 to the track 21 and is biassed towards the groove 20 in the track by a spring 35. When the door reaches the closed (or open) position, the leading roller 18 engages the shoe 31 causing it to pivot because the distance between its distal end and the groove 20 is less than the diameter of the roller 18 (seen in broken outline). This causes extension of the spring 35 which consequently absorbs the energy of the moving door causing its speed of movement to be reduced as it approaches the closed position. The door may finally be brought to rest by contact of the leading roller 18 with the rod 33.

FIG. 9 shows one form of a guiding device for the door. Mounted on the lower edge of the door 11 is a channel member 40 having depending walls 41. A roller 42 is mounted for rotation about a vertical axis on a guide 43 and is disposed between the walls 41 of the channel member 40. There is sufficient play between the roller 42 and the walls of the channel member 40 to permit the door to move towards the aperture in the closed position. The guide 43 is vertically adjustable by means of a clamping screw 44 in a guide slot 45 so that, if desired, for example to remove the door from the sliding door mechanism, it is possible to disengage the roller 42 from the channel member.

FIG. 10 shows an alternative form of guiding device wherein a bracket 50 is mounted on the lower edge of the door and is engaged by a roller 51 mounted for rotation about a vertical axis. The roller 51 is carried by a spring loaded arm 52 which urges the roller into contact with the bracket 50. Thus movement of the door away from the wall is resisted. However, the spring loaded arm 52 allows slight movement of the door in the closed position away from the aperture. Thus if an excess pressure should build up in the space being closed by the door this can be relieved because the door will move sufficiently away from the wall against the action of the spring loaded arm so that the excess pressure escapes around the seal 27.

FIG. 10 also shows, in broken lines, the distance the door can be pivoted away from the wall about the bearing blocks 15 connecting the hangers 10 to the track 17.

FIG. 11 shows schematically the direction of the force $P_U$ acting upon the sliding door mechanism of FIG. 1. The $P_U$ is at an angle $\alpha$ to the horizontal so that the horizontal component $P_H$ of the force $P_U$ is $P_U \cos \alpha$. If the force exerted by the mass of the door is $P_O$ then the horizontal component $P_H$ is $\cos \alpha / \sin \alpha \; P_O$. In a sliding door mechanism according to the present invention, the angle $\alpha$ is preferably arranged to be greater than 45°, for example 50° to 60°, so that the horizontal component $P_H$ is a fraction of the force $P_o$ exerted by the mass of the door.

Conventional sliding door mechanisms are designed to produce as large a horizontal component $P_H$ as possible by reducing the angle $\alpha$ below 45° to ensure that the door is tightly sealed around the aperture in the closed position. In certain applications the door may weigh 100 kgs or more and conventional sliding door mechanisms may require 1.4 to 1.7 or more times that force to move the door from the closed position. Consequently, it may be necessary to lever the door open. In contrast, with a sliding door mechanism according to the present invention, the angle $\alpha$ is preferably greater than 45° so that the force needed to move the door from the closed position is only a fraction of the weight of the door. Consequently, the door can be opened with a force smaller than the weight of the door and the door does not have to be levered open. Moreover, it is expected that there will be less wear on the sliding door mechanism, especially the rollers and tracks so that a sliding door mechanism according to the present invention will have a longer life than conventional sliding door mechanisms.

FIG. 12 shows a connector 100 for use with a sliding door mechanism according to the present invention when the door is moved between open and closed positions by means of a motor (not shown). The motor, which is fixed either directly or indirectly to the wall, drives an endless chain or belt (not shown) which is substantially co-extensive with the path of movement of the door. The chain or belt is secured by means (not shown) in a groove 101 of a fork member 102 of the connector 100. The connector has a bracket 103 which is fixed, for example by bolts, to the sliding track 17 of the sliding door mechanism. The fork member 102 is slidable axially on a shaft 104 fixed to the bracket 103 but is biassed to a position centrally of the bracket by a pair of springs 105. A tongue 106 projects from the bracket to actuate limit switches (not shown) to de-energise the motor when the door is in the open and closed positions.

The connector 100 has the advantage that the drive between the chain or belt and the sliding door mechanism is not rigid and the springs 105 smooth the starting motion of the door when the motor is engergised and damp the stopping motion of the door when the motor is de-energised.

A sliding door mechanism according to the present invention can be used, for example, in cold rooms, drying rooms or controlled atmosphere rooms.

If the door is relatively small only one second roller 24 may be required.

What is claimed is:

1. A sliding door mechanism for closing an aperture in a wall comprising: an elongate support means; hanger means pivotally connected to the elongate support means and arranged to be fixed to the door whereby the door is suspended from the elongate support means; an arm on the elongate support means extending in the length direction thereof and carrying a plurality of spaced apart first rollers; a track which, in use, is fixed to the wall and receives the first rollers, said rollers providing a downward force component against said track; a guide rail mounted on the track, said guide rail having a discontinuous section proximate said aperture; and at least one second roller mounted on the elongate support means for engaging the guide rail, said at least one second roller providing an upward force component against said guide rail, the arrangement being such that, in use, the elongate support means is locked to said track by said upward and downward force component and, as the door reaches a closed position in which it closes the aperture from an open position in which the aperture is not obstructed by the door, the guide rail discontinuous section and the at least one second roller causes the elongate support means to pivot about the contact points of the first rollers with the track and the hanger means pivot relative to the elongate support means.

2. A sliding door mechanism as claimed in claim 1 in which the arm of the elongate support means is at an angle greater than 45° to the vertical when the door is in the open position and is at an angle of 60° or greater to the vertical when the door is in the closed position.

3. A sliding door mechanism as claimed in claim 2 in which the arm of the elongate support means is at an angle of 50° or greater to the vertical when the door is in the open position and is at an angle of 70° or greater to the vertical when the door is in the closed position.

4. A sliding door mechanism as claimed in claim 1 or 2 in which the axes of rotation of the first and second rollers are substantially parallel.

5. A sliding door mechanism as claimed in claim 1 or 2 in which the surface of each first roller engaging the track is convex.

6. A sliding door mechanism as claimed in claim 1 or 2 in which the surface of the or each first roller engaging the track is concave.

7. A sliding door mechanism as claimed in claim 1 or 2 in which the guide rail is cylindrical, each second roller having a concave surface in contact therewith.

8. A sliding door mechanism as claimed in claim 1 or 2 including a guiding device, in use, arranged adjacent a lower edge of the door, the guiding device having a spring-loaded member urging the door towards the aperture in the closed position and/or the open position.

9. A sliding door mechanism as claimed in claim 1 or 2 including braking means on the track for engaging one of the first rollers as it reaches the closed position to reduce the speed of movement of the door as it approaches the closed position.

10. A sliding door mechanism as claimed in claim 1 or 2 including a resilient coupling member a first part of which is fixed to the guide rail and a second part of which is attachable to a drive mechanism, resilient means being arranged to control axial sliding movement between the first and second parts.

* * * * *